US005524443A

United States Patent [19]

Frank

[11] Patent Number: 5,524,443

[45] Date of Patent: Jun. 11, 1996

[54] METHOD OF COOLING A VENDING MACHINE AND A VENDING MACHINE FOR CARRYING OUT THE METHOD

[75] Inventor: John Frank, Odense, Denmark

[73] Assignee: Witteborg A/S, Odense C., Denmark

[21] Appl. No.: 256,851

[22] PCT Filed: Jan. 28, 1994

[86] PCT No.: PCT/DK93/00033

§ 371 Date: Jul. 26, 1994

§ 102(e) Date: Jul. 26, 1994

[87] PCT Pub. No.: WO93/15480

PCT Pub. Date: Aug. 5, 1993

[30] Foreign Application Priority Data

Jan. 29, 1992 [DK] Denmark ..... 0107/92

[51] Int. Cl.[6] ..... A47F 3/04

[52] U.S. Cl. ..... 62/89; 62/256

[58] Field of Search ..... 62/255, 256, 89

[56] References Cited

U.S. PATENT DOCUMENTS

| | | | |
|---|---|---|---|
| 3,365,907 | 1/1968 | Barroero | 62/256 |
| 3,769,805 | 11/1973 | Corini | 62/255 X |
| 4,369,632 | 1/1983 | Abraham | 62/256 X |
| 4,379,391 | 4/1983 | Rhee | 62/408 |
| 4,831,841 | 5/1989 | Falk | 62/256 X |
| 5,058,393 | 10/1991 | Callon et al. | 62/255 |

FOREIGN PATENT DOCUMENTS

| | | |
|---|---|---|
| 1574263 | 1/1967 | Germany . |
| 3040339 | 6/1981 | Germany . |
| 2123938 | 9/1982 | United Kingdom . |
| 2108477 | 10/1982 | United Kingdom . |

*Primary Examiner*—William E. Tapolcai
*Attorney, Agent, or Firm*—Ladas & Parry

[57] ABSTRACT

A method of cooling a vending machine in which the products are stored behind a closable opening at the front side of the vending machine, said opening being opened for a direct removal of the product at the activation of the vending machine, said method implying that a flow of cold air (36, 37, and 42) is directed substantially between the products adjacent the delivery area and the opening. The vending machine comprises a plurality of drums (3) rotatably journalled about a vertical axis, as well as a front window adapted to be opened for a direct access to at least one removal opening (8). The flow of air in question is provided by means of a vertical outlet slot (22) directed substantially tangentially towards the front side of the drums (3) and a horizontal downward outlet slot (26).

5 Claims, 3 Drawing Sheets

METHOD OF COOLING A VENDING MACHINE AND A VENDING MACHINE FOR CARRYING OUT THE METHOD

TECHNICAL FIELD

The invention relates to a method of cooling a vending machine comprising a plurality of drums rotatably journalled about a vertical axis, each drum being placed behind a pane at the front side of the vending machine, said pane being opened for a direct removal of a product stored on the corresponding drum at the activation of the vending machine, by which method a flow of cold air is directed substantially between the products adjacent the delivery area and the panes, and at least one portion of the flow of cold air is guided as an air carpet from above and downwards to an execution opening placed at the bottom of the vending machine. The invention relates furthermore to a vending machine for carrying out this method.

BACKGROUND ART

A desire of storing food products in vending machines for a long period, i.e. more than 48 hours, involves a requirement to the storing room temperature which must be between 0° to 3° C. inside the vending machine even during the removal of the products. This requirement has necessitated that optimum cold flows of air are applied to the storing room so as the keep the temperature low everywhere therein also during the removal of the product and so as to avoid formation of dew on the cooled portions subjected to the effects of the surroundings during the delivery of the product.

From DE-A-3 040 339 a vending machine is known, in which cold air is guided downwards behind a glass door in front of an array of shelves.

DESCRIPTION OF THE INVENTION

The method according to the invention is characterised in that the portion of the flow of cold air guided as an air carpet from above and downwards is guided downwards on the outer side of the panes.

In this manner the products are particularly well protected against the high temperatures of the surroundings when a pane is open. In addition, formation of dew is efficiently prevented on the remaining panes, which is especially due to the fact that a layer of cold air is always maintained on both sides of the panes.

The cooled portions subjected to the surroundings during the delivery of the product are prevented from gathering dew especially on account of the cold air carpet made of dry air.

The invention relates furthermore to a vending machine for carrying out the method, said vending machine comprising a plurality of drums rotorably journalled about a vertical axis, each drum being placed behind a pane at the front side of the vending machine, said pane being adapted to be opened for a direct removal of a product stored on the corresponding drum at the activation of the vending machine, and where the vending machine comprises means for providing a continuous flow of cold air to and substantially in front of the products adjacent the panes, and where means are provided for directing a portion of the flow of air supplied in front of the products are an air carpet from above and downwards to an exsuction opening at the bottom of the vending machine. The vending machine according to the invention is characterised in that it is provided with means for directing the portion of the flow of air supplied as an air carpet from above and downwards on the other side of the panes. In this manner the panes are efficiently protected against formation of dew at the same time as a protecting carpet of cold, dry air is provided in front of the opening being opened at the activation of the vending machine.

BRIEF DESCRIPTION OF THE DRAWING

The invention is described in greater detail below with reference to the accompanying drawing, in which.

BEST MODE FOR CARRYING OUT THE INVENTION

Figure 1:
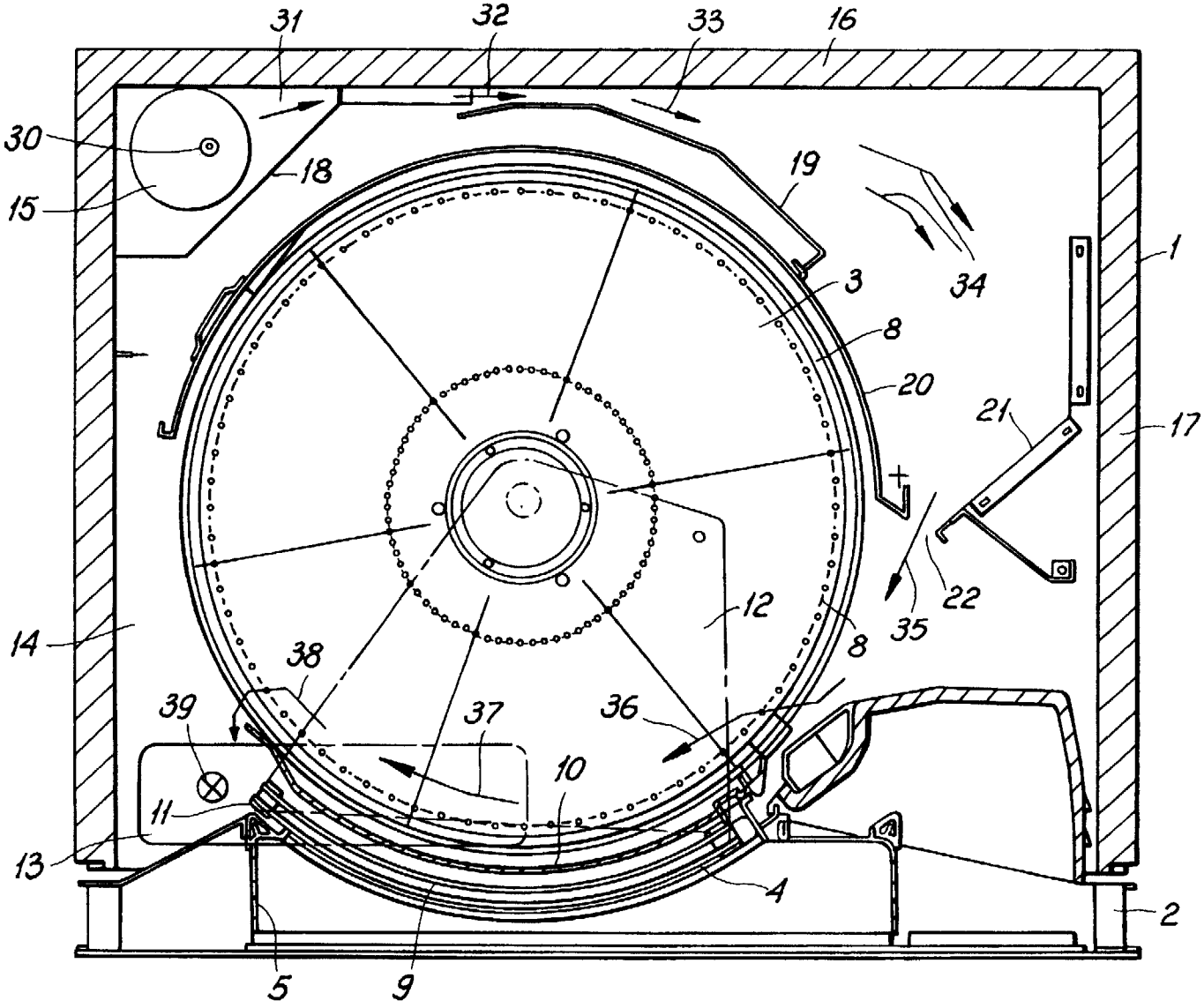
FIG. 1 is a horizontal, sectional view through a preferred embodiment of a vending machine according to the invention, which includes a plurality of drums rotatably journalled about a vertical axis, and removal openings allowing removal of the products at activation of the vending machine, which besides comprises a large common outer insulating pane and an inner pane associated with each drum.

The vending machine shown in the drawing is of substantially the same type as the one described in Danish printed accepted specification No. 147 150 B. It comprises a cabinet 1 with a door 2 allowing access to the interior of the vending machine by way of unlocking. The cabinet 1 comprises a stack of drums 3 rotatably journalled about a vertical axis, said stack of drums being displayed through a front window designated the general reference numeral 4. The front window is provided in an opening 5 in the door 2. Each drum 3 comprises radial partitions 6 dividing each drum 3 into compartments 7 receiving their respective product. These compartments 7 are associated with a removal opening 8 along the circumference of the drum, through which the product in question can be removed when the vending machine has been activated in a suitable manner. The door 2 of the cabinet I comprises means not shown in greater detail, through which the customer can activate the vending machine such as for instance by inserting a suitable amount of money and carrying out the desired choice of product by activating a handle opposite each drum.

The front window 4 is formed by an outer insulating pane 9 and an inner pane 10 associated with each drum 3. The outer insulating pane is of a curved shape and such an extent in both axial and circumferential direction that in the closed position it covers the entire opening 5 in the door 2 and consequently the entire stack of drums 3 in the axial direction, viz. the vertical direction. The outer insulating pane 9 comprises a frame 11 supported at the top and the bottom by an upper and lower, respectively, radial plate-shaped bracket 12, only the lower bracket appearing from FIGS. 1 and 3. This bracket is rotatably journalled about the same vertical axis as the drums 3. The outer insulating pane 9 is connected to a motor not shown by means of a crank mechanism not shown in greater detail either. The motor allows a turning of the insulating pane between the closed position shown FIG. 1 and the opened position shown in FIG. 3.

Each inner pane 10 is also of a curved shape and an extent corresponding in the circumferential direction to the circumferential extent of the outer insulating pane 9, whereas in axial direction it is of an extent corresponding to the height of each drum 3. The inner pane 10 is supported by a supporting bracket (not shown) rotatably journalled on the rim of the associated drum 3.

Each inner pane is adapted to engage each partition 6 on the associated drum 3 and disengage said partition when the handle of the inner pane in question is activated. When a means of payment is inserted, the outer insulating pane 9 is caused to turn clockwise about the axis of rotation until it reaches the position shown in FIG. 3 with the result that the handles of the inner panes 10 are accessible.

Figure 2B:
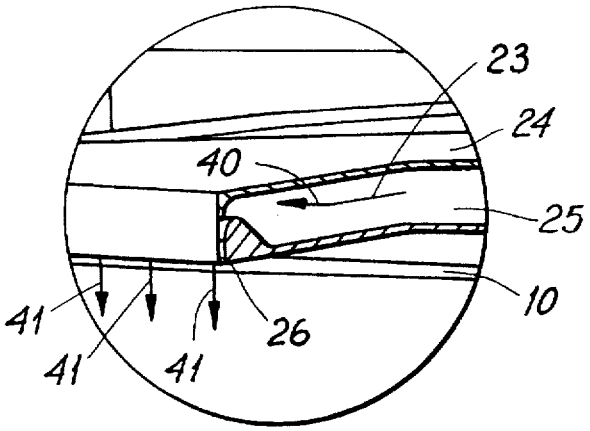
FIG. 2B illustrates on a larger scale the framed portion of FIG. 2A.

The outer insulating pane 9 continues to move until it is completely opened. When the product has been removed from the drum 3, the insulating pane 9 returns to the closed position, whereby it causes the just activated inner pane 10 to follow its movement until the outer insulating pane 9 is in the closed position. Then another removal opening is advanced to the removal position inside the vending machine. Compared to the vending machine of Danish printed accepted specification, the vending machine shown in the drawing is particularly new in comprising means for ensuring a circulation of the cold flows of air. These means are provided in connection with the cooling system of the vending machine, said cooling system being placed at the bottom of the cabinet 1. The cooling system is associated with a blower not shown, which sucks air past the evaporator of the cooling system from an exsuction opening 13 in the bottom of the compartment 14 of the vending machine with the stack of drums 3. Subsequently, the blower blows the air now cooled into the compartment 14 again through an inlet opening 15 placed at the back of the cabinet 1. The inlet opening 15 communicates with a channel system extending from the side of the cabinet in which the outer insulating pane 9 is situated in the opened position, along the rear wall 16 of the cabinet 1 and forwards along the opposite side wall 17 of said cabinet. The channel system is defined by vertically extending thin walls 18, 19, 20, and 21, which form a narrow, vertically extending outlet slot 22 adjacent the side wall 17 of the cabinet. The outlet slot 22 is shaped in such a manner that the air is directed forwards towards the door 2 of the vending machine substantially in a tangential direction relative to the drums 3. As shown in FIG. 2B, the described channel system is at the top defined by a horizontally extending, substantially plane channel 23 defined by two horizontal, parallel walls 24 and 25. These walls 24 and 25 extend to the front window 4, where they form a horizontally extending, downwardly directed, narrow outlet slot 26. The outlet slot 26 extends substantially along the entire upper rim of the front window 4 and is adapted to direct a flow of air vertically downwards towards the bottom of the compartment 14 between the outer insulating pane 9 and the inner panes 10.

Figure 3:
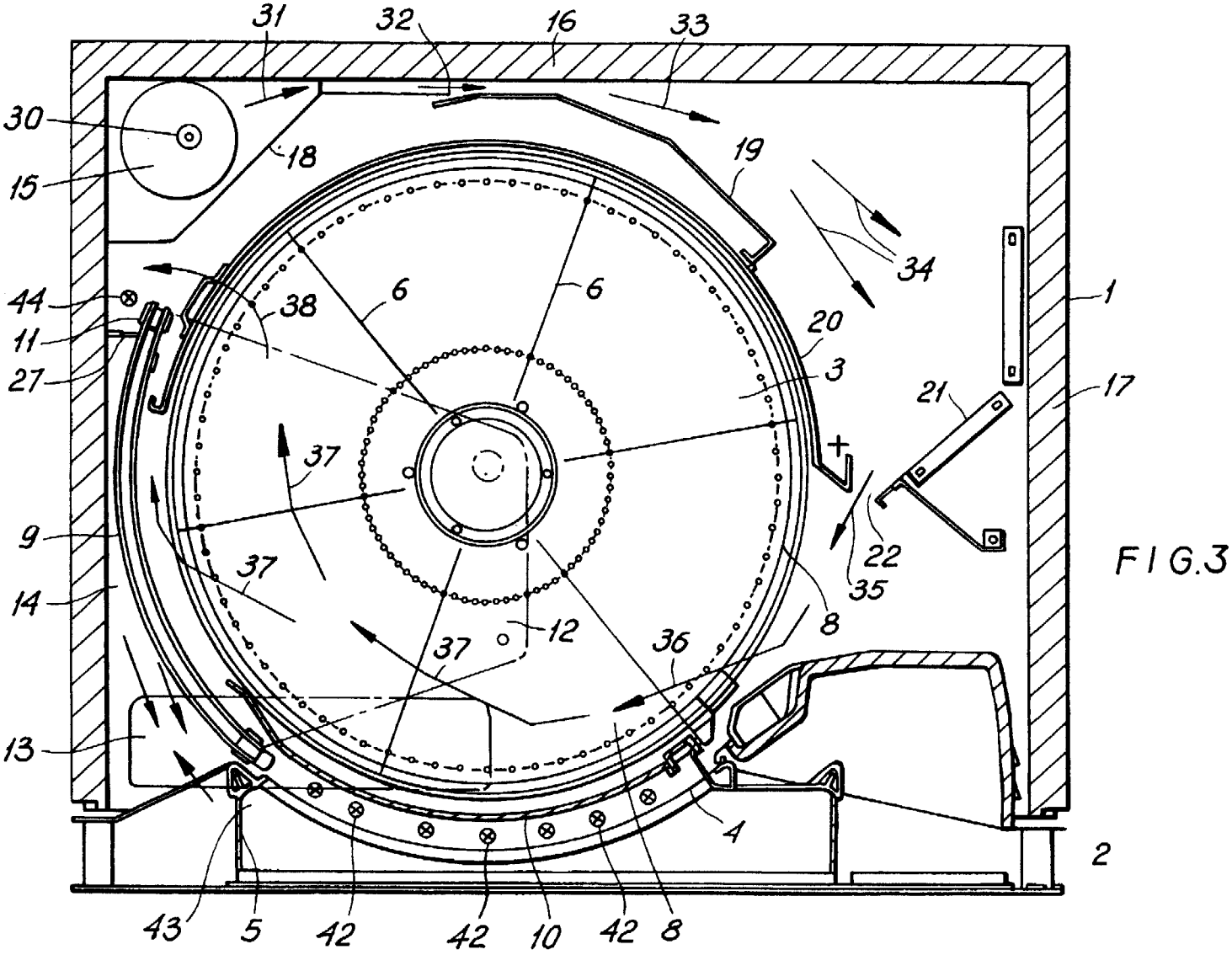
FIG. 3 illustrates the same as FIG. 1, but whereby the outer insulating pane is shown in the opened position.

As illustrated in FIG. 3, a vertically extending sealing sheet 27 is provided, which is adapted to co-operate with the end of the outer insulating pane 9 placed farthest inside the compartment 14 when said insulating pane 9 is in the opened position. In this manner cold air is completely prevented from flowing to the outer side of the outer insulating pane 9 when said pane is in the opened position.

When the vending machine is used and the front window is closed, cold air flows into the channel system from the inlet opening 15 as indicated by means of the point of an arrow 30. Then air flows round in horizontal direction through the channel system defined by the walls 18, 19, 20, and 21, cf. the arrows 31, 32, 33, and 34. From the vertical outlet slot 22, the air continues as indicated by means of an arrow 35 tangentially inwards along the drums and forwards towards the inner side of the front window 4. In this manner the air circulates substantially along the inner side of the front window 4 as indicated by means of the arrows 36 and 37 so as finally to flow to the side and downwards along the stack of drums 3 and out through the exsuction opening 13, cf. the arrows 38 and 39. Thus, while flowing along the inner side of the front window 4, the air circulates substantially between the front window 4 and the products on the drums.

Figure 2A:
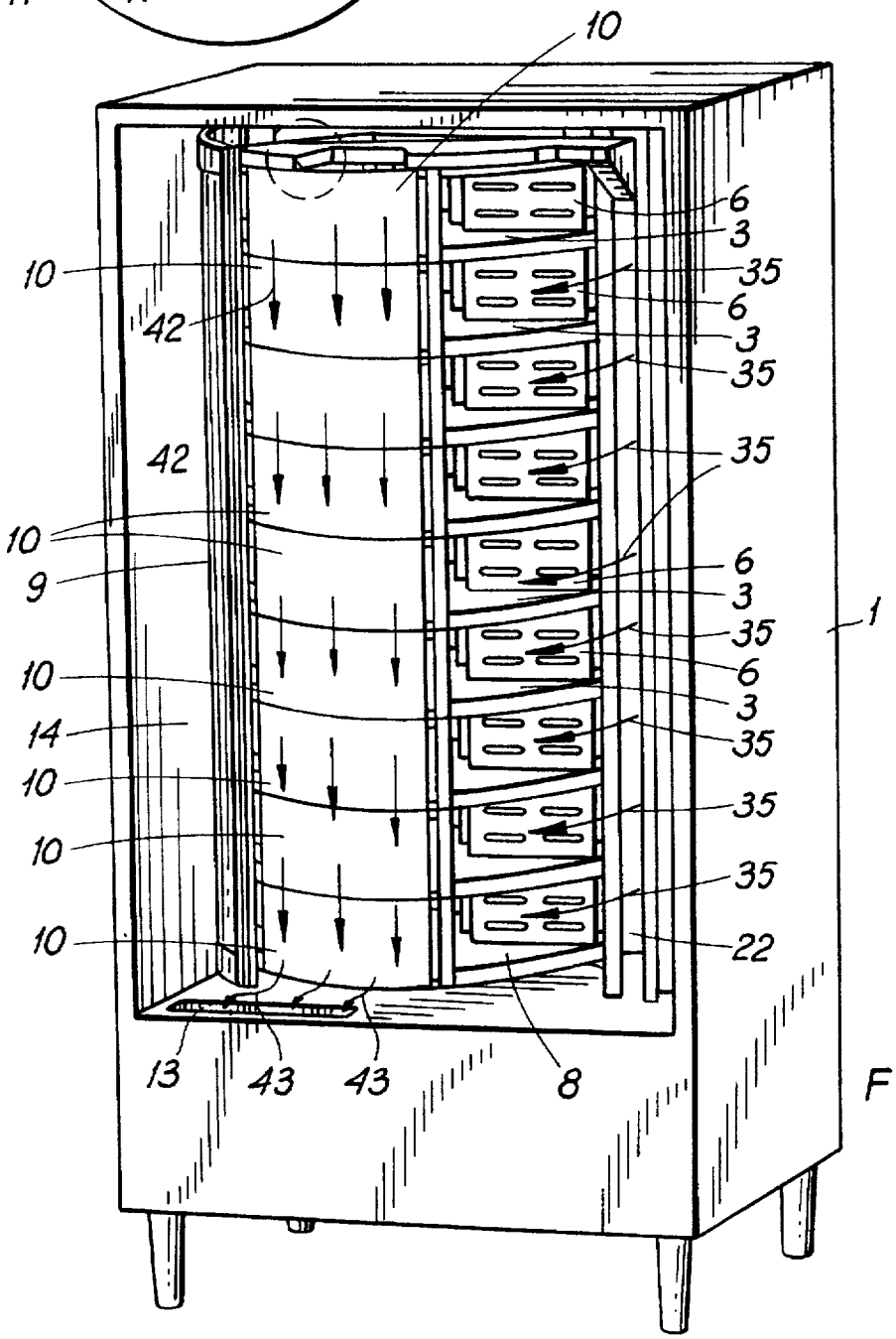
FIG. 2A is a front perspective view of the same vending machine, whereby parts have been removed for the sake of clarity, and whereby the outer insulating pane is shown in the opened position and all the inner panes are shown in the closed position.

The air from the outlet opening 15 flows through the channel system and also upwards to and through the horizontal channel 23 above the stack of drums 3 and then out through the vertical downwardly directed outlet slot 26 downwards along the outer sides of the inner panes 10 inside the outer insulating pane 9, cf. the arrows 40, 41, and 42, respectively, of FIG. 2A. From the lower rim of the front window, the vertically extending air carpet flows out through the exsuction opening 13 in the bottom of the compartment, cf. the arrows 43.

When the vending machine has been activated to deliver a product, the insulating pane 9 is in the position shown in FIG. 3. As a result, the flow of air from the vertical outlet slot 22 is directed the entire way round along the inner side of the inner panes 10 and along the inner side of the outer insulating pane 9 to the inner vertically extending rim of the inner insulating pane. The sealing sheet 27 prevents the cold air from flowing onto the front side of the insulating pane 9. Instead the cold air flows vertically downwards as shown by means of the arrow 44 so as finally to flow below the lower radial bracket 12 of the outer insulating pane 9 and forwards to the exsuction opening 13.

The described flowing paths of the cold air ensure that an overpressure always applies inside the compartment and especially immediately inside the removal openings 8 when access is allowed thereto, In this manner air is efficiently prevented from entering the machine from the outside. At the same time the vertical air carpet on the outer side of the inner panes ensures that-said panes remain cooled and thereby protected against formation of dew, The sealing sheet 27 efficiently prevents cold air from flowing onto the front side of the insulating pane 9 in the opened position thereof with the result that the outer side of the insulating pane 9 maintains the temperature of the surroundings for a rather long period, whereby dew is not formed thereon even when said pane is opened for a long period.

The invention has been described with reference to a preferred embodiment. Many modifications can be performed without thereby deviating from the scope of the invention as defined in the appended claims.

I claim:

1. A method of cooling a vending machine comprising a plurality of drums rotatably journalled about a vertical axis, each drum being placed behind an associated inner pane at the front side of the vending machine, each said associated pane having an outer side thereof and being opened for a direct removal of a product stored on the corresponding drum at the activation of the vending machine, by which method a flow of cold air is directed substantially between the products adjacent the panes, and at least one portion of the flow of cold air is guided as an air carpet from above and downwards to an exsuction opening placed at the bottom of the vending machine, said method including the step of directing a portion of the flow of cold air as an air carpet from above and downwards on the outer side of the associated panes.

2. The method of cooling a vending machine according to claim 1 wherein the vending machine further comprises an outer insulating pane, said directing step further directing said portion of air from above and downwards between the associated inner panes and the outer insulating pane.

3. A vending machine comprising a plurality of drums rotatably journalled about a vertical axis, each drum being placed behind a an associated inner pane at the front side of the vending machine, each said associated pane having an outer side thereof and being adapted to be opened for a direct removal of a product stored on the corresponding drum at the activation of the vending machine, and first means for providing a continuous flow of cold air to and substantially in front of the products adjacent the panes, and where second means is provided for directing a portion of the flow of air supplied in front of the products as an air carpet from above and downwards to an exsuction opening at the bottom of the vending machine, said second means being provided for directing the portion of the flow of air from above and downwards on the outer side of the associated panes.

4. A vending machine according to claim 2 further including an outer insulating pane adapted to be in an opened position for accessing a product stored in a said drum wherein said second means further directs said portion of air from above and downwards between the associated inner panes and the outer insulating pane.

5. A vending machine according to claim 4 further including a sealing means adapted to cooperate with the outer insulting pane when said outer pane is in an opened position to prevent cold air from flowing past the front side of the outer insulating pane.

* * * * *

UNITED STATES PATENT AND TRADEMARK OFFICE

CERTIFICATE OF CORRECTION

PATENT NO. : 5,524,443
DATED : June 11, 1996
INVENTOR(S) : John Frank

It is certified that error appears in the above-indentified patent and that said Letters Patent is hereby corrected as shown below:

Column 1, line 17, "execution" should read -- exsuction

Column 1, line 28, "the" (1st. occ) should read--to--.

Column 2, line 2, "other" should read -- outer --.

Column 2, line 49, "I" should read -- 1 --.

Column 4, line 40, "," should read --. --.

Column 4, line 43, delete "-".

Column 4, line 44, "," should read -- . --.

Column 5, line 11, delete "a".

Column 6, line 14, "insulting" should read -- insulating

Signed and Sealed this
Twenty-eighth Day of January, 19

*Attest:*

Bruce Lehman

BRUCE LEHMAN

*Attesting Officer* *Commissioner of Patents and Trademarks*